United States Patent [19]

Vöhringer

[11] 4,169,560

[45] Oct. 2, 1979

[54] ELECTROSTATIC SPRAY GUN FOR POWDERED MATERIAL

[75] Inventor: Gerhard F. Vöhringer, Friedrichshafen, Fed. Rep. of Germany

[73] Assignee: Elektrostatische Spritz— und Beflockungsgesellschaft G.F. Vohringer GmbH, Oberteuringen-Neuhaus, Fed. Rep. of Germany

[21] Appl. No.: 878,377

[22] Filed: Feb. 16, 1978

Related U.S. Application Data

[62] Division of Ser. No. 670,976, Mar. 26, 1976, Pat. No. 4,088,268.

[30] Foreign Application Priority Data

Mar. 29, 1975 [DE] Fed. Rep. of Germany ..... 2514160

[51] Int. Cl.[2] ..... B05B 5/02

[52] U.S. Cl. ..... 239/698; 239/600

[58] Field of Search ..... 239/456, 515, 600, 697, 239/698

[56] References Cited

U.S. PATENT DOCUMENTS

| | | | |
|---|---|---|---|
| 3,667,675 | 6/1972 | Sherman et al. | 239/698 |
| 4,114,564 | 9/1978 | Probst | 239/697 X |

*Primary Examiner*—Robert W. Saifer

*Attorney, Agent, or Firm*—Haseltine, Lake & Waters

[57] ABSTRACT

An electrostatic spray gun for powdered material in which separate connections for supplying powder and compressed air are provided together with a spray tube and spray nozzle. A charging device charges the powder electrostatically. The connections for the powder and compressed gas supply are held in a common housing portion. A gun barrel, together with spray nozzle, constitute nested hollow members fastened to the front of the housing. A barrel head on an outer end of the gun barrel holds the spray nozzle to the outer end of the spray tube which is fastened axially and radially to the housing by an exterior barrel tube. A spacer which encloses the spray tube is held on both ends and is fixed to rotate with housing and barrel head.

10 Claims, 7 Drawing Figures

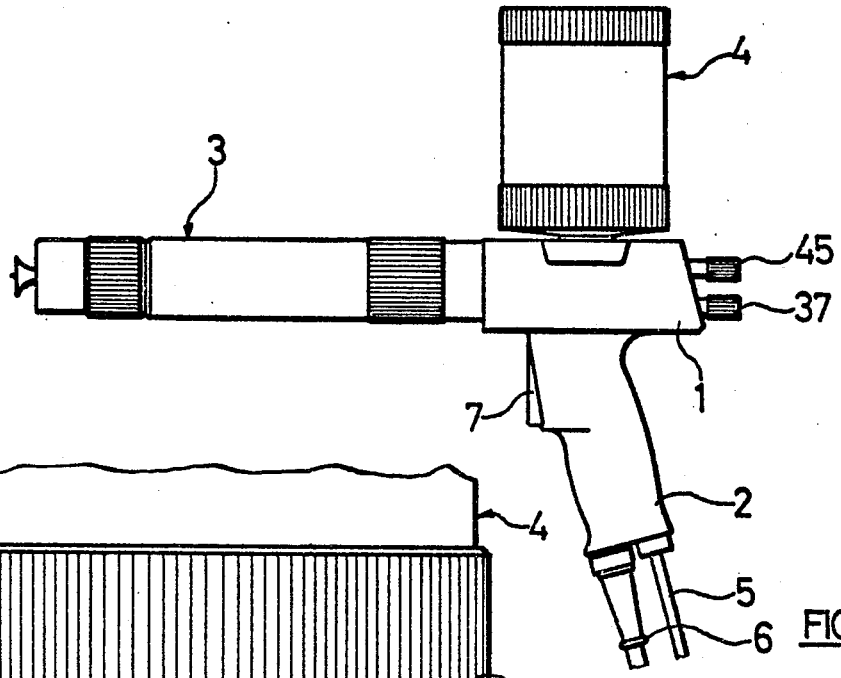
FIG. 1
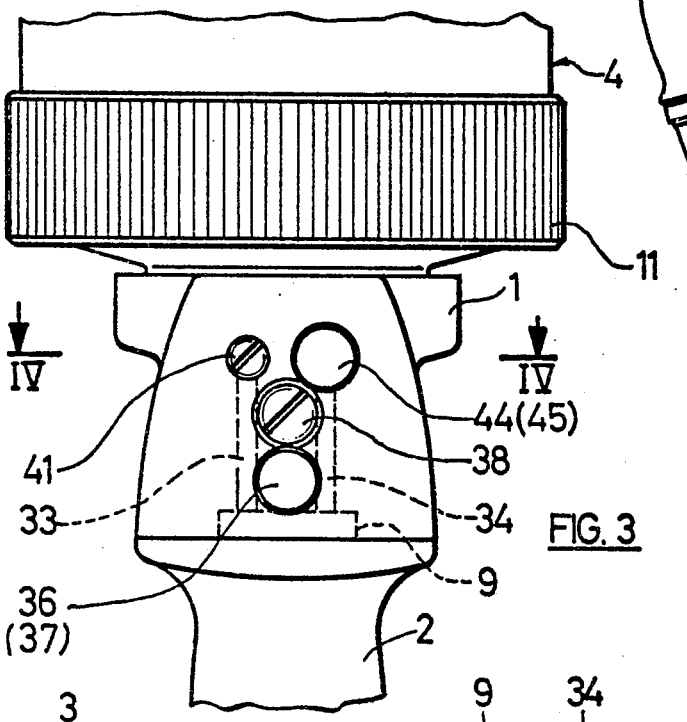
FIG. 3
FIG. 4
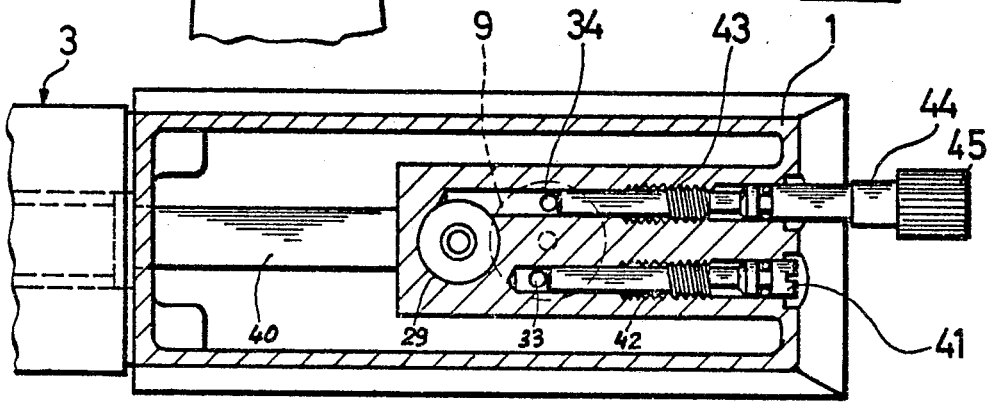

ELECTROSTATIC SPRAY GUN FOR POWDERED MATERIAL

This is a division of application Ser. No. 670,976 filed Mar. 26, 1976 and now U.S. Pat. No. 4,088,268.

BACKGROUND OF THE INVENTION

The present invention relates to an electrostatic spray gun for powdered material with separate connections for supplying powder and compressed gas, and an intake device for introducing the powder to a conveying gas stream. A spray tube, a spray nozzle and a charging device for electrostatically charging the powder are also provided.

With electrostatic spray guns, a conveying or carried gas with powder particles distributed therein is usually supplied via a hose connection from a stationary injector. They may be portable hand spray guns or automatic guns mounted on a stand.

From the German Utility Pat. No. 7,311,211, there is known a manual spray gun with attached powder magazine. The magazine bottom is formed by a sieve through which the powder is sucked downward into the conveying gas stream. To loosen the powder, there is located above the sieve an agitating vane which is operated by an impeller driven by compressed air. The handling is already cumbersome because the compressed air must be delivered from the bottom end of the handle through a hose to the upper end of the powder magazine. Also, no uniform withdrawal of the powder is achieved in this manner. Regulating the powder supply is just as inaccurate and difficult as guiding the gun and adjusting the other variables. Therefore, it is not possible to ensure with this conventional manual spray gun, a uniform application of the powered material.

It is, therefore, an object of the present invention to provide an electrostatic spray gun of the initially mentioned type with the most universal application so that all variables important to the spraying process can be set quickly, conveniently and precisely, to achieve a uniform powder application with widely varying coating problems.

Another object of the present invention is to provide an electrostatic spray gun of the foregoing character which is compact and may be economically fabricated.

A further object of the present invention is to provide a spray gun, as described, which has a substantially long operating life and may be readily maintained in service.

SUMMARY OF THE INVENTION

The objects of the present invention are achieved by providing that the connections for supplying powder and compressed gas and an injector is mounted on a common housing portion which comprises supply channels for powder and conveying gas from their connections to the injector, a metering gas channel from the compressed gas connection to the powder supply channel and control valves located therein and in the conveying gas channel. Such a housing portion can accommodate in a limited space all required connecting channels and adjusting elements. It can be used for manual spray guns or automatic devices. Since the mixture of powder and conveying gas is prepared by an injector within the spray gun and both components can be adjusted separately, the concentration of the powder in the conveying gas stream can be adjusted very accurately with great uniformity of powder distribution. All adjustment elements can be located close together and thus reduce the handling time for changing the settings.

In one embodiment, the common housing portion holds a connection for a powder magazine and a connection for loosening gas supplied to the powder magazine; the letter connection is connected by a channel, which is part of the housing portion and which has another control valve, to the compressed-gas connection. Hence, the powder magazine can be attached directly and carried by hand in the case of manual spray guns. This is advantageous for the short-time change of color and sprayed material, when coating small areas, for laboratory purposes and sample applications. When making a change, only the powder magazine has to be changed.

When the connection for the powder magazine can be closed by a cover which in turn has a connection for a powder supply hose, the same spray gun can be used with the powder magazine attached or with an exterior powder supply, e.g., an intermediate tank on a higher level which, in a suitable manner, receives its powder supply. If the spray gun is to be used exclusively as an automatic sprayer mounted on a stand, the magazine connection can be dispensed with.

It appears to be particularly expedient to stagger the supply channels parallel to each other and transversely to a normal center plane and to provide staggered parallel channels for accommodating valves and an injector nozzle section whose adjustment elements are accessible from the rear of the housing portion. Hence, only a few parallel bores have to be made, which requires little effort. This makes it possible to have the adjusting elements close together and easily accessible.

In one embodiment, the powder magazine is divided by a gas-permeable disk of porous material into an upper and a lower magazine space of which the lower space is connected to a supply line for loosening gas. This line is located inside the housing portion and provided with an adjustable control valve, while the upper magazine space is connected by a suction line with gradient to an injector-like device through which conveying gas flows. The compressed gas "seeping up" through the partition takes continuously changing paths through the spray material in the powder magazine and prevents caking at some points. The powder is loosened and is delivered uniformly to the suction line.

It is advantageous to bring up the suction line via the partition; there the line has at least one lateral intake opening. In this manner, the bearing pressure has no significant influence on the powder supply and the powder cannot be directly forced into the suction line.

If possible, the upper end of the suction line should be enclosed by an annular space which is connected only below in the direction of the partition with the upper magazine space. As a result, the powder is withdrawn immediately above the partition, i.e., the withdrawal can be made nearly unchanged till the magazine is completely emptied, but the powder must be conveyed first upward through the annular space before it can enter the suction line which brings about a better distribution in the gas flow.

The upper end of a suction tube may have a detachable bell-shaped cap which bounds the annular space. In this manner, the covered intake opening can be quickly opened for cleaning.

The lower rim of the annular space or of the cap should have a distance from the partition such that this distance is very much smaller than the distance of the intake opening from the partition, 15 to 20% of the latter distance. The inside cross section of the annular space should be several times, particularly eight to ten times, the cross section of the suction line.

It is also advisable to attach the suction line in a holding tube of the powder magazine which, at the same height level as the suction line, has at least one lateral intake opening. Instead of a single intake opening, there are normally at least two openings which face each other and are separated by stringers.

It is advantageous to provide in the suction line an annular clearance enclosed by an annular chamber. Via a control valve located inside the headpiece, metering air for regulating the amount of withdrawn powder can be introduced from the outside. The greater the amount of metering air supplied, the less powder is drawn off if the remaining conveying gas conditions remain unchanged, since the metering air reduces the pressure gradient from the powder magazine to the conveying gas line.

The annular chamber and the annular clearance can be formed in a single manner between a projection of a magazine bottom section and a depression located in the housing portion. Then, a metering gas supply line can be easily located in the housing portion and should, if possible, discharge tangentially into the annular chamber. The axially carried powder enters a rotating metering gas plume, is exposed to a vortex in the suction line and thus, is distributed more uniformly in the gas stream.

The invention further relates to an electrostatic spray gun for powdered material with a housing portion, a gun barrel which comprises a spray tube and a spray nozzle on the free end. This makes possible, without changing the remaining parts of the device, a multifarious barrel construction and making all parts of the barrel quickly and conveniently accessible for replacement.

For this purpose, the gun barrel, with the spray nozzle of detachably nested hollow bodies, is interchangeably fastened to the front side of a housing portion. Only by loosening this fastening can the barrel be removed and disassembled, a feature that offers a special advantage in checking for faults in cleaning and converting for other purposes.

In a preferred embodiment, at least one spray tube and a barrelhead carrying the spray nozzle is fastened, axially and radially, to the housing portion by an external barrel tube, screwed on in the form of a cap knot, where the barrel tube is threaded to a barrel base detachably fastened to the housing portion. Since the barrel tube holds the individual parts up to the barrel head on the housing portion, these parts can be easily taken out after the barrel tube is unscrewed. So that adjustment movements of various types can also be made in the nozzle area, without effecting the rearward parts, such as loosening the barrel tube, a spacer enclosing the spray tube should be rotatably coupled with both ends on the housing portion, both at the barrel base and at the barrel head. This is relatively simple when the spacer has a rectangular exterior cross section and engages front side transverse grooves of barrel base and barrel head.

Especially with the latter embodiment, a high voltage supply line may be located in a simple manner in the annular space between barrel tube and spacer. The rim grooves are preferably located in the area of the transverse grooves.

A high voltage supply cable can be pulled through a hollow handle and a recess in the head piece up to the gun barrel, and can be connected there to a protective resistor.

On the free end of the barrel head, the spray nozzle can be located on the inside. The nozzle sleeve, movable in the lengthwise direction of the barrel, can be detachably located on the outside. They are advantageously held by static friction by means of O-rings, and are movable on the nozzlehead. Without using any tools, these parts can be shifted, removed or replaced when the barrel tube remains in its mounted position.

In a preferred embodiment, the spray nozzle has a rod which passes axially through the spray opening. A conic baffle, which can be moved along the lengthwise axis is located at an axial distance from the nozzle opening. Here, the baffle and/or the nozzle sleeve can be used alternatively to vary the annular passage between the two parts, and to cause a varying deflection of spray powder and conveying gas. The baffle can be mounted by means of an inserted O-ring so its position may be adjusted along the rod. Of two interchangeable spray nozzles, at least one should have an axially projecting electrode on the free rod end, and the other should have such an electrode on the nozzle opening located on the rear of the nozzle sleeve. The former electrode arrangement is used for coating profiled building sections through more intense focussing of the powder stream towards the center, while the latter, with internal (electrostatic) charge, brings about a deposition of the powder on a larger surface.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a side view and shows a spray gun in accordance with the present invention;

FIG. 3 is a rear view of the headpiece, viewed from the right of FIG. 2;

FIG. 4 shows a section taken along line IV—IV in FIG. 3.

DESCRIPTION OF THE PREFERRED EMBODIMENTS

Figure 2:
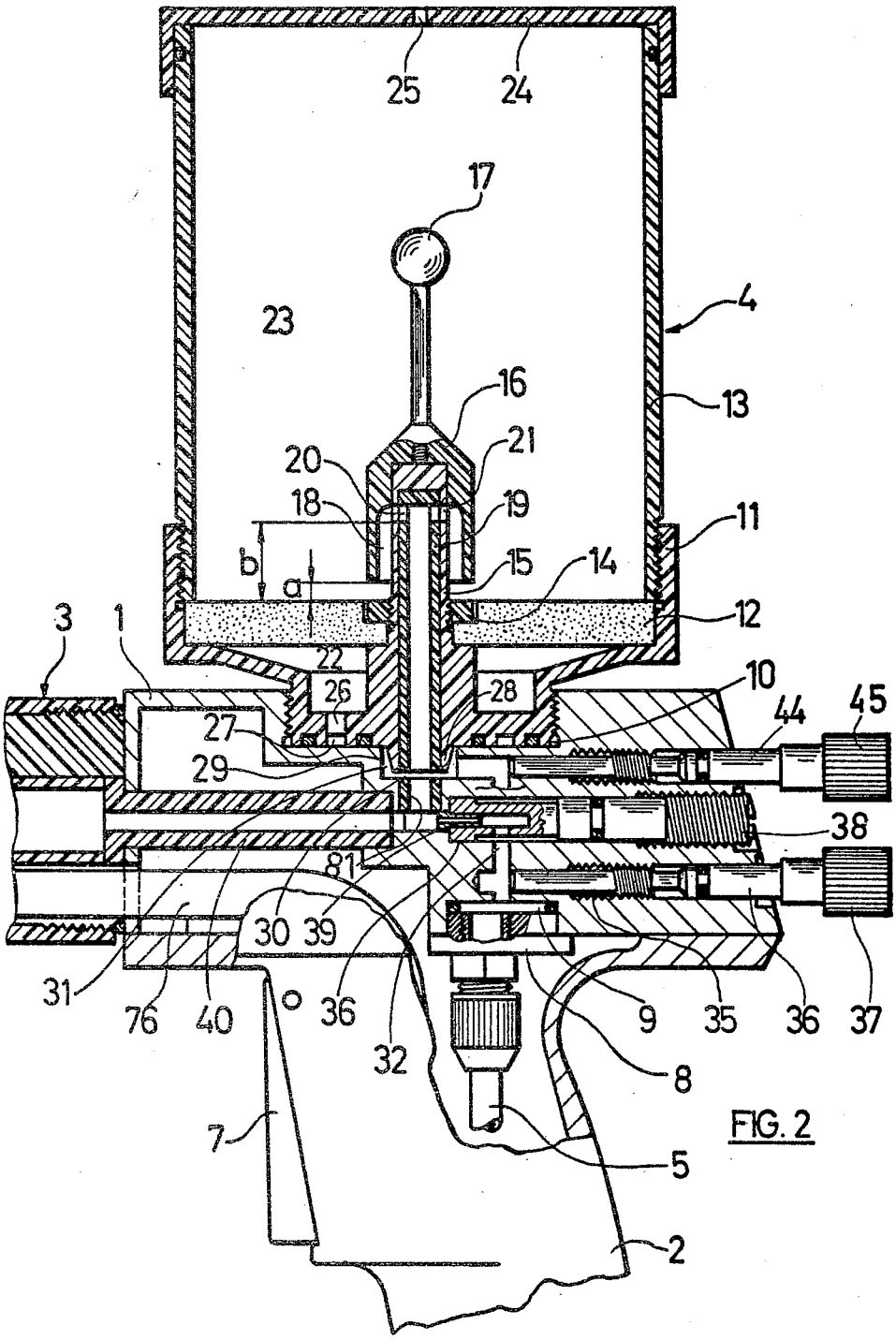
FIG. 2 is a lengthwise section through a housing portion which has the form of a headpiece and through a powder magazine.

Referring to FIG. 1, the handgrip 2, the gun barrel 3 and the powder magazine 4 are fastened detachably on different sides of a gun headpiece. Various operating elements project from the rear side of the headpiece. A compressed gas line 5 and a high-voltage cable 6 are attached to the bottom end of the hollow handgrip 2. High voltage and compressed-gas supply are controlled by trigger 7 in a manner not described here.

Referring to FIGS. 2 through 4, the compressed gas line 5 is connected to a cover 8 which covers a cylindrical counter-sunk hole 9 formed in the bottom side of headpiece 1. Another cylindrical countersunk hole 10 is formed in the top side of the headpiece symmetrical with a normal center plane, like countersunk hole 9. The cup-shaped bottom part 11 of powder magazine 4 is screwed into the thread in countersunk hole 10. This bottom part has a horizontal partition 12 of porous gas-permeable material and is held by its rim at the bottom portion by a cylindrical shell 13 of transparent material and in its center by a nut 14 which is fastened to a pipe nipple 15 projecting from the underside. The pipe nipple 15 is closed on its top and has a cap 16 which can be lifted by means of a handle 17. As a result, there is between pipe nipple and cap an annular space 18 which opens downward and to the outside at a distance a from the partition 12.

Inside pipe nipple 15 is a powder suction tube 19 which in the same radial plane as the pipe nipple has on the upper end of annular space 18, several lateral intake openings 20 which are separated by stringers. The corresponding intake openings in the pipe nipple are denoted by 21. The distance b of the intake openings from the partition 12 is five times the distance a of the cap from the partition. The cross section of the annular space is eight to ten times the cross section of the discharge tube.

The partition 12 divides the powder magazine into a lower magazine space 22 and an upper magazine space 23. The latter is closed by a cover 24 with ventilation opening 25. The lower magazine space is connected via an axial hole 26 with an annular groove 27 formed in the bottom side of the bottom portion.

An attachment 28, of bottom portion 11, which holds the suction pipe 19, projects into a cylindrical depression 29 of headpiece 1 with a distance from the latters bottom. As a result, there is formed between suction pipe and its stub 81 in the headpiece an annular clearance 30 which is surrounded by an annular chamber 31. Suction pipe 19 and stub 81 are made of a wear-proof synthetic material such as teflon.

Referring particularly to FIG. 4, from the compressed gas supply 5, three supply bores 32 for conveying gas, 33 for loosening gas and 34 for metering gas are brought out. The middle supply bore for conveying gas is penetrated by a first valve bore 35, entering from the rear side of the headpiece parallel to the gun barrel, and ending in a nozzle bore 36 in the center of the gun barrel. Into valve bore 35, a throttle valve element 36 is threaded which through a knob 37 in the rear can be screwed in till its valve barrel in the supply bore 32 brings about the required throttling of the conveying gas flow.

In the nozzle bore 36, an injector nozzle 38 is screwed in till it hits the stop. Its interior space is connected via a radial bore and a peripheral groove to the conveying gas bore 32. The conveying or carrier gas flows from its interior space through a nozzle 39. The diameter of the line carrying conveying gas triples shortly before joining the powder-carrying line through the suction pipe 19 and stub 81. The conveying gas flow is supplied to the gun barrel without change in direction by a flange bushing 40 inserted into the headpiece.

The supply bore 33 for loosening gas is brought up to the countersunk hole 10 and there meets annular slot 27 from where the gas passes through bore 26 into the lower magazine space 22, passes through partition 12, and permeates the powder contained in powder magazine 4 over numerous alternating flow paths. Through the injector effect achieved by nozzle 39, gas is sucked through the suction pipe 19, the intake openings 20, 21 and the annular space 18 immediately above the partition, and carries along loosened powder which thus is introduced into the conveying gas flow. Since the powder is sucked in directly above the partition, the powder magazine can be emptied almost completely. The suction through the intermediate space 18 results in a further loosening and uniformity of distribution in the gas flow. For regulating the loosening gas flow, there is a throttle valve 41 which, in accordance with FIG. 4, is screwed into a valve bore 42 in the rear side of the headpiece. The valve stem of this throttle valve 41 can be slid into the supply bore 33.

The third supply bore 34 ends at a short distance before countersunk hole 10 in a valve bore 43 which holds a throttle valve 44 with adjusting knob 45 and discharges tangentially into depression 29 and thus into annular chamber 31. The metering gas, to be throttled by valve 44, produces a rotational vortex in the annular chamber 31 concentric with the suction pipe 19 and flows from the outside through annular clearance 30 in the form of a rotating gas mist into the suction pipe. Since the gas quantity drawn in by the injector essentially remains just as constant as the powder concentration in the loosening gas passing through the suction pipe, this powder concentration is regulated in nozzle 79 by the amount of metering gas. Since the axial powder gas flow hits the rotating metering gas mist, a vortex and further uniformity of powder distribution results.

Figure 5:
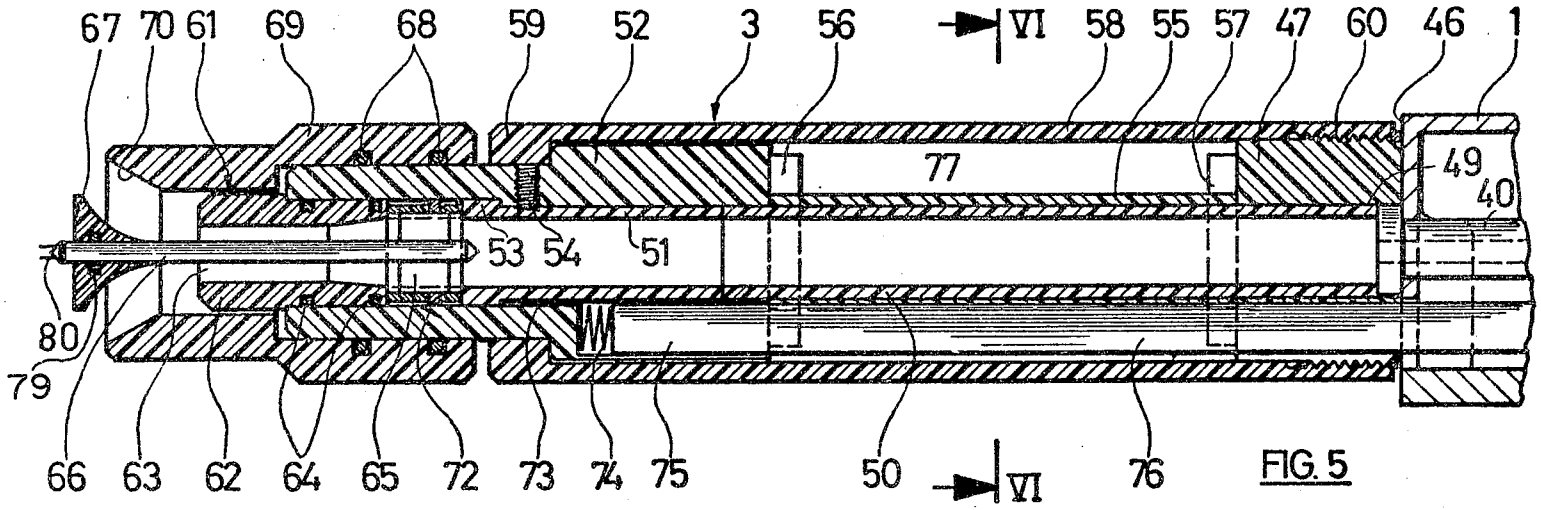
FIG. 5 shows a lengthwise section through the spray gun barrel.
Figure 6:
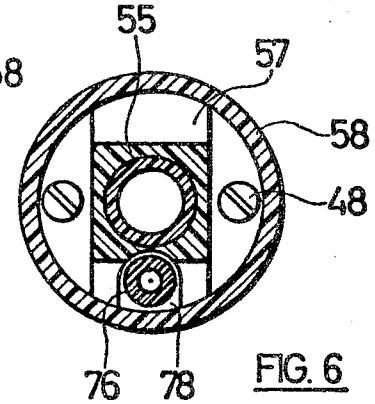
FIG. 6 shows a section taken along line VI—VI of FIG. 5.

As indicated by FIGS. 5 and 6, a bushing-shaped barrel base 47 is fastened by means of two screws 48 to the forward front side 46 of headpiece 1. The bore 49 in this barrel base encloses the flange of flange bushing 40, which projects from the headpiece, and holds the rear end of a two-section spray tube 50, 51. The forward spray tube section 51 is seated in a bushing-shaped barrel head 52, rests with its outer flange 53 against an inside shoulder, and is fastened to the barrel head by a setscrew 54. On the spray tube section 50 which projects slightly into the barrel head, there is located between barrel head and barrel base a spacer 55 which has a square cross section and whose ends fits into transverse grooves 56 of the barrel head 57 and the barrel base. These parts are enclosed by a barrel tube 58 whose inside flange 59 rests against a shoulder of the shaft barrel and is screwed via thread 60 to the barrel base. By unscrewing the shaft tube, the entire gun barrel can be taken off, and the enclosed parts can be pulled apart and taken out.

Connected to flange 53 of the forward spray tube section 51, there is located in the free end of the barrel head 52 a spray nozzle 61 whose nozzle portion 62 forms a nozzle opening 63 and is held by O-rings 64 in annular grooves of the inside surface of barrel head. On the rear end of the nozzle, star-like arranged stringers 65 hold a nozzle rod 66 which protrudes through the nozzle opening 63 and mounts a baffle 67 which is held by an O-ring 79 and can be moved in a lengthwise direction.

On a cylindrical outside surface of the barrel head, displaceable lengthwise and held by O-rings, there is a nozzle sleeve 69 which ends in front in a tapering baffle surface 70. The powder particles, ejected axially from the nozzle opening 63, are first deflected by the cone-shaped concave baffle surface 70 of baffle 67 radially to the outside. The further the nozzle sleeve 69 is slid forward, the more powder particles are deflected forward or back by the baffle surface 70. Hence, exit direction and distribution of the powder may be preset by setting the nozzle sleeve 69.

The further directing of the powder particles to the workpiece is done by electrostatic forces after being charged in a force field which emanates from two electrodes 80 projecting freely from the end of nozzle rod 66. These electrodes are connected, in a manner not shown here, with a contact ring 72 fastened to the spray nozzle. The exterior surface of this ring makes contact with a contact wire 73 along the interior wall of the barrel head. This contact wire 73 is connected via spring windings 74 to a protective resistor 75 which, in addition to a high-voltage cable 76, is located in the annular space 77 between spacer 55 and barrel tube 58 and in rim grooves 78 which are located in the area of the transverse grooves 56, 57 in barrel head and barrel base.

Figure 7:
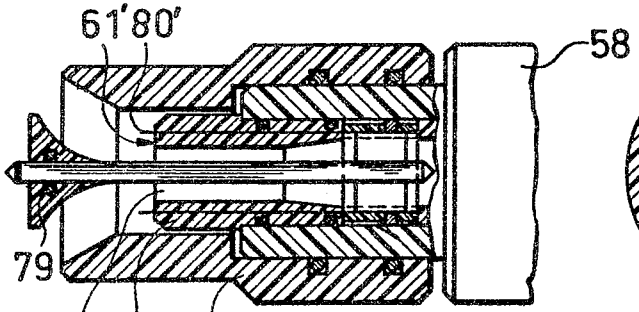
FIG. 7 shows a partial lengthwise section through the forward barrel end with a modified spray nozzle.

The modification, shown in FIG. 7, with spray nozzle 61', differs from the embodiment of FIG. 5 in that the electrodes 80' project at the nozzle opening 63 from the nozzle 62. In this manner, the electrostatic force field is concentrated less intently on the barrel axis. This is more advantageous when spraying large plane surfaces. On the other hand, with complex parts, the spray nozzle of FIG. 5 is more practical.

To operate the powder spray gun, the powder magazine is filled to 75% of its capacity and the compressed air line 5 is connected, preferably via a coupling piece, to a compressed air source. The throttle valve 41 for loosening gas is closed all the way, and, after connecting the high-voltage cable 6, which also contains control lines for regulating the compressed air supply, the trigger 7 is pulled and compressed gas is admitted to the headpiece. Now the throttle valve 36 for conveying gas can be adjusted to a suitable value. Then the operator gradually opens the throttle valve 41 till a proper upward flow of the conveying gas is observed in the powder magazine. By adjusting the metering valve element 44, the concentration of powder in the conveying gas flow can be readjusted. This readjustment, like the fine adjustment of the conveying gas valve 36, can be changed during operation. The angle of the spray jet is continuously variable between 30° and 120° by moving the nozzle sleeve 69.

By simply unscrewing them, powder magazines with different coating material can be quickly interchanged. In place of a powder magazine, a cover may be placed into a countersunk hole. This cover has a connection for supplying powder via a hose or similar item from an intermediate magazine attached in a suitable manner. The spray gun, without any major modification, may be used as a stationary automatic spraying device.

The present invention may also be used in a special-purpose spray device, without the handgrip, and the high-voltage cable and the compressed-air connection can be introduced from the rear of a housing portion corresponding to headpiece 1. Control devices for loosening gas can be dispensed with, and the adjustment elements can be located, e.g., on a side surface of this housing portion. It may be suitable for forming the annular clearance 30 and annular chamber 31 to attach a powder supply connection to a detachable cover section.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. An electrostatic spray gun for powdered material comprising, in combination, a common housing; connection means for supplying powder and compressed gas; a spray tube, a spray nozzle; a charging device for electrostatically charging the powder, said connection means for the powder and compressed gas supply being held in said common housing portion; a gun barrel, said gun barrel with said spray nozzle comprising detachably nested hollow members fastened replaceable to the front side of said housing; a barrel head mounted on an outer end of said gun barrel and holding said spray nozzle fitting to an outer end of said spray tube fastened axially and radially to said housing by an exterior barrel tube; and a spacer enclosing said spray tube and held on both ends and rotating with said housing and said barrel head.

2. The spray gun as defined in claim 1, including a barrel base fastened detachably to said housing, said barrel tube being threaded to said barrel base.

3. The spray gun as defined in claim 2, wherein said spacer has a rectangular external cross section and engages front side transverse grooves of said barrel base and said barrel head.

4. The spray gun as defined in claim 3, including a high voltage line in annular space between said barrel tube and said spacer and in rim grooves from said barrel base and said barrel head, said rim grooves being located in proximity of said transverse grooves.

5. The spray gun as defined in claim 4, including a hollow handle for passing therethrough said high voltage line; and a protective resistor in a recess in said housing, said high voltage line passing through said recess in said housing to said gun barrel and being connected to said protective resistor.

6. The spray gun as defined in claim 5, including an adjustable nozzle sleeve; said spray nozzle on the inside of said barrel head on the free end thereof and said nozzle sleeve on the outside of said barrel head being removably attached and being shiftable in the longitudinal direction of the barrel.

7. The spray gun as defined in claim 6, including O-rings on the outside of said barrel head for holding said spray nozzle and O-rings on the inside of said barrel head for holding said nozzle sleeve by static friction.

8. The spray gun as defined in claim 7, wherein said spray nozzle comprises a rod passing axially through said spray opening, a cone-shaped baffle mounted on said rod at an axial distance from the nozzle opening.

9. The spray gun as defined in claim 8, including an O-ring for attaching said baffle to said rod, said baffle being mounted on said rod and being movable in the longitudinal direction of said rod.

10. The spray gun as defined in claim 8, including two interchangeable spray nozzles, one spray nozzle having at least one axially projecting electrode on the free end of said rod, and one spray nozzle having an electrode on the nozzle opening located to the rear of said nozzle sleeve.

* * * * *